US005106337A

United States Patent [19]

Knox

[11] Patent Number: 5,106,337

[45] Date of Patent: Apr. 21, 1992

[54] COIN SORTER AND DISPENSER

[75] Inventor: William W. Knox, Mentor, Ohio

[73] Assignee: Mag-Nif, Inc., Cleveland, Ohio

[21] Appl. No.: 354,480

[22] Filed: May 19, 1989

[51] Int. Cl.[5] ..... G07D 3/04; G07D 1/08

[52] U.S. Cl. ..... 453/9; 221/259; 453/49

[58] Field of Search ..... 453/9, 19, 20, 29, 40, 453/49; 221/259, 277

[56] References Cited

U.S. PATENT DOCUMENTS

| | | | |
|---|---|---|---|
| 693,047 | 2/1902 | Miller | 453/49 |
| 2,265,748 | 12/1941 | Slezak | 221/277 X |
| 2,423,166 | 7/1947 | Arenson | 453/29 |
| 3,313,477 | 4/1967 | Brown | 453/9 |
| 4,221,227 | 9/1980 | Heiman | 453/9 |
| 4,495,959 | 1/1985 | Farber | 453/9 |

FOREIGN PATENT DOCUMENTS

| | | | |
|---|---|---|---|
| 1166532 | 11/1958 | France | 453/19 |
| 0155054 | 1/1963 | U.S.S.R. | 453/49 |
| 0250560 | 8/1969 | U.S.S.R. | 453/49 |

*Primary Examiner*—F. J. Bartuska

*Attorney, Agent, or Firm*—Renner, Otto, Boisselle & Sklar

[57] ABSTRACT

A coin sorter and dispenser includes side-by-side vertical coin chambers for sorted coins. The stacks of coins are supported on respective friction wheels which are exposed at the bottom so that a user may engage the bottom of a selected wheel and rotate it so that the top of the wheel slides the lowermost coin in a stack through an exit clearance to drop into the hand of the user. The friction wheels engage the stacks near the front edge and the rear edge of the stack is supported on sloping ramps to ensure that the lowermost coin slides forwardly through the clearance. Coins are fed through a top slot to be size sorted into the respective chambers. The sorter is formed of injection molded snap together front and back parts with a snap-on cover plate over the slightly inclined upper sorting portion of the front part. The front part is transparent so the number of coins in each chamber may be seen. When the front and rear parts snap together they capture along the front lower edge a shaft on which the friction wheels are mounted for rotation. The rear of the back part may be provided with a magnetic pad or tape so that the coin sorter and dispenser may be mounted on a refrigerator door or wall at a convenient height.

16 Claims, 2 Drawing Sheets

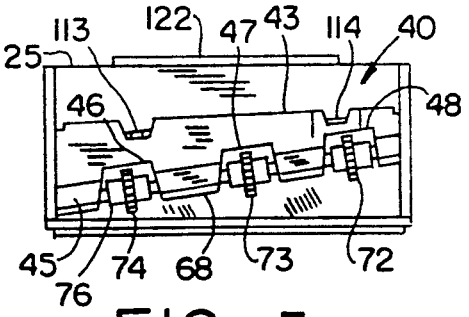
FIG. 5
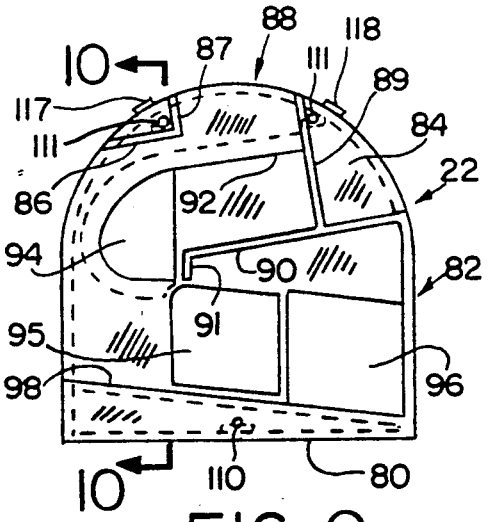
FIG. 9
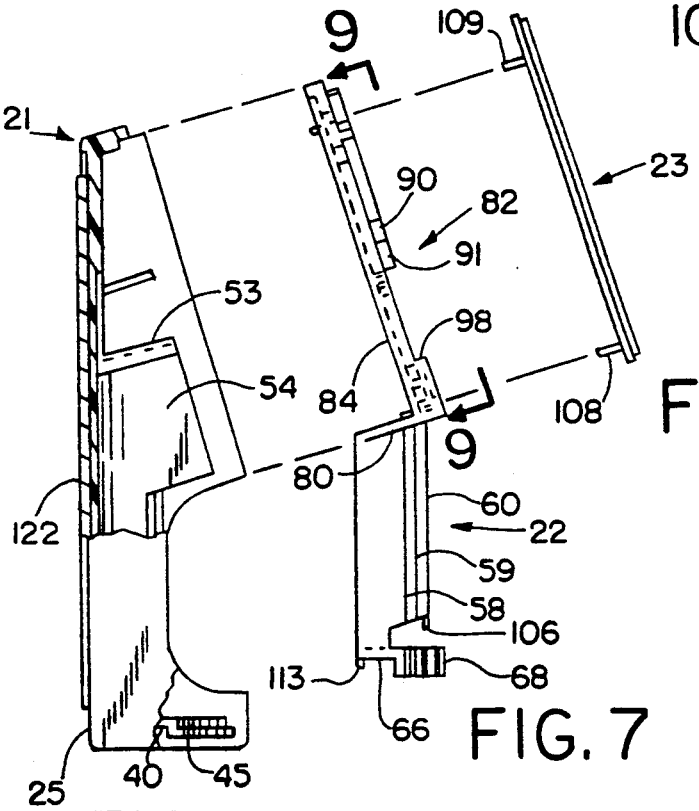
FIG. 8
FIG. 7
FIG. 6
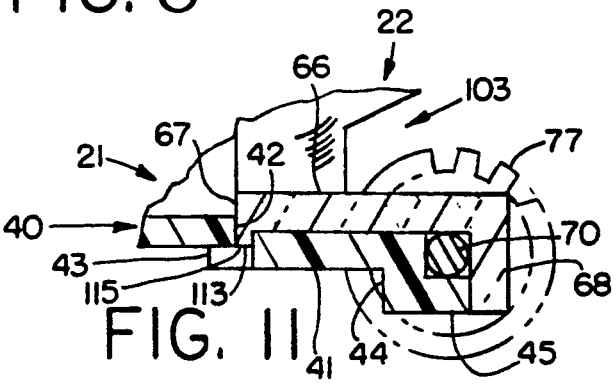
FIG. 11
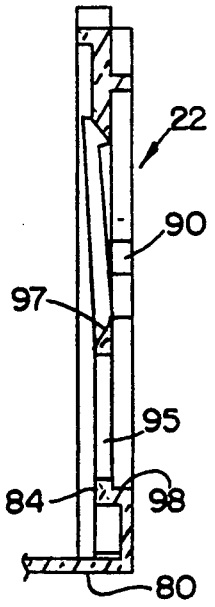
FIG. 10

COIN SORTER AND DISPENSER

BACKGROUND OF THE INVENTION

Coin dispensers have been employed, and a common variety is that usually designed to be worn on a belt. It contains a plurality of side-by-side containers into which appropriate coins are fed. Coins are dispensed from the bottom by pressing a selected lever to slide the lowermost coin outwardly to drop into the hand of the user. Such dispensers are usually made of metal, are fairly complex, heavy and expensive. Moreover, the coins have to be sorted before being dropped into the proper container. Such dispensers cannot be mounted on a vertical surface in plain sight of the user, or if so mounted, they have to be mounted securely to resist the downward pressure of the finger operated lever. Such dispensers are not really practical for household use.

There is accordingly a need for an inexpensive and simple coin sorter and dispenser which can be readily mounted on a vertical surface such as a refrigerator wall or door, and from which selected coins can be removed one at a time. The force required to remove a coin should be of little magnitude and should not be directed downwardly. Also, coins fed to the sorter and dispenser should be reliably classified into the proper container or compartment.

SUMMARY OF THE INVENTION

A coin sorter and dispenser includes side-by-side vertical coin chambers for sorted coins. The stacks of coins are supported on respective friction wheels which are exposed at the bottom so that a user may engage the bottom of a selected wheel and rotate it so that the top of the wheel slides the lowermost coin in a stack through an exit clearance to drop into the hand of the user. The friction wheels engage the stacks near the front edge and the rear edge of the stack is supported on sloping ramps to ensure that the lowermost coin slides forwardly through the clearance. Coins are fed through a top slot to be size sorted into the respective chambers. The sorter is formed of injection molded snap together front and back parts with a snap-on cover plate over the slightly inclined upper sorting portion of the front part. The front part is transparent so the number of coins in each chamber may be seen. When the front and rear parts snap together they capture along the front lower edge a shaft on which the friction wheels are mounted for rotation. The rear of the back part may be provided with a magnetic pad or tape so that the coin sorter and dispenser may be mounted on a refrigerator door or wall at a convenient height.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 5 is a bottom plan view;

FIG. 6 is a side elevation of the rear part partially broken away and in section;

FIG. 7 is a side elevation of the front part;

FIG. 8 is a side elevation of the cover plate which snaps over the upper portion of the front part;

FIG. 9 is an elevation of the upper portion of the front part as seen from the line 9—9 of FIG. 7;

FIG. 10 is an enlarged fragmentary vertical section of the upper portion of the front part as seen from the line 10—10 of FIG. 9; and FIG. 11 is a further enlarged fragmentary vertical section of the lower edge of the front and rear parts assembled illustrating the capture of the friction wheel shaft.

DETAILED DESCRIPTION OF THE PREFERRED EMBODIMENTS

Figure 1:
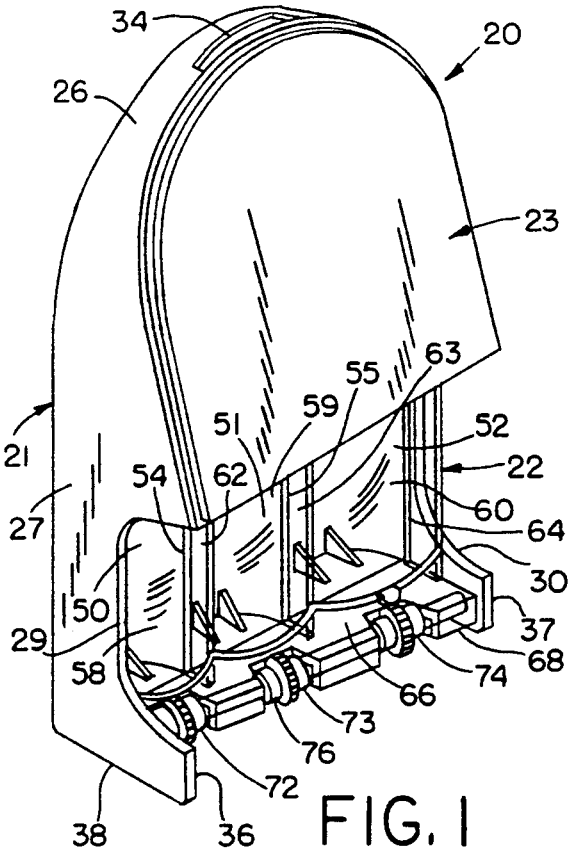
FIG. 1 is an isometric of a coin sorter and dispenser in accordance with the present invention.

Referring first to FIGS. 1–4 there is illustrated a coin sorter and dispenser shown generally at 20 in accordance with the present invention. The coin sorter includes a rear part 21, a front part 22, the upper slightly rearwardly inclined portion of which is covered by a cover plate 23. The rear part 21 and the cover plate 23 may be opaque injection molded plastic while the front part 22 is a transparent injection molded plastic.

The rear part includes a vertically extending back wall 25 and a rounded top wall 26 which extends tangentially into side walls 27 and 28. The front edges of the side walls are cut away as indicated at 29 and 30 and above such cut-away portions the edges of the side walls and top walls extend slightly rearwardly inclined as indicated at 32. The rounded top wall is normal to such inclination and is provided with a center coin receiving slot indicated at 34.

Below the cut-away portions 29 and 30 the front edges of the side walls extend vertically downwardly as indicated at 36 and 37 and then horizontally rearwardly as seen at 38 and 39, respectively.

Referring now to FIG. 5 and also FIG. 11 it will be seen that the rear part includes a bottom wall shown generally at 40 which includes a forwardly projecting portion 41 which is offset downwardly to form an upper shoulder indicated at 42 in FIG. 11, which extends across the top of the bottom wall parallel to the back of the rear part. The rear edge of the lower portion of the offset is indicated generally at 43.

The bottom wall 40 continues forwardly and then extends downwardly as indicated at 44 to terminate in a short horizontal shelf 45. The front edge of the wall is notched as indicated at 46, 47 and 48 in FIG. 5 and such edge extends across the front of the dispenser at a slight angle with respect to the rear wall 25.

Figure 3:
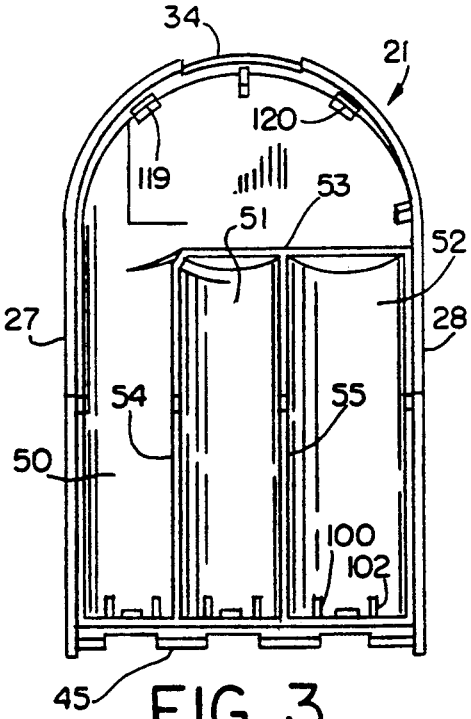
FIG. 3 is a front elevation of the rear part.

The interior of the back part is provided with three forwardly opening semi-cylindrical vertically extending cavities seen at 50, 51 and 52 which progressively increase in size from left to right as seen in FIGS. 1 and 3. The left hand cavity 50 extends the full height of the back part while the center and right hand cavities 51 and 52 extend to a wall 53 and are separated from each other and cavity 50 by forwardly projecting walls 54 and 55, such walls having the profile configuration seen more clearly in FIG. 6.

The lower portion 58 of the front part 22 also includes semi-cylindrical vertical walls indicated at 58, 59 and 60. The semi-cylindrical wall sections 58 and 59 are joined by a vertically extending partition wall 62 which abuts against the edge of wall 54 of the rear part. Similarly, the semi-cylindrical sections 59 and 60 include an intermediate partition wall 63 abutting against the edge of wall 55 of the rear part. The lateral outside edges of the sections 58 and 60 telescope within the side walls of the rear part 21 and abut against vertical shoulders as seen at 64 in FIG. 1.

The lower end of the edge and intermediate walls of the semi-cylindrical sections of the front part 22 terminates in a bottom wall 66, the rear edge 67 of which is parallel to the back 25 and is adapted to seat against the shoulder 42 of the bottom wall 40 of the rear part. The bottom wall 66 of the front part extends forwardly and is notched in the same manner as seen by the notches 46, 47 and 48 in FIG. 5 and includes between such notches downturned flanges 68. The flanges 68 extend at the same angle with respect to the back as the shelves 45 at the front edge of the bottom wall of the back part. This angle is seen more clearly in FIG. 5.

The purpose of the flanges 68 and shelves 45 is to capture and fix transversely extending shaft 70 as seen in FIG. 11 on which finger friction wheels 72, 73 and 74 are mounted for selective rotation. The shaft is also dimensioned with respect to the side walls to keep it from rotating. As seen more clearly in FIGS. 1 and 5, each finger wheel includes an axially extending hub 76 and a serrated central radially projecting wheel portion 77 which, as also seen in FIG. 11, projects substantially above the top of the front part of bottom wall 66 and below the horizontally aligned edges of the shelves 45 and the bottom edge of flanges 68. The hubs 76 fit in the notches 46, 47 and 48 and such notches keep the hubs and thus the finger wheels properly in position. The friction finger wheels may be formed of a soft plastic or elastomeric material.

The upper end of the semi-cylindrical wall sections 58, 59 and 60 terminate in a slightly upwardly inclined wall 80. Above such wall the front part includes an upper coin sorting portion shown generally at 82. Such upper coin sorting portion comprises a slightly rearwardly inclined plate 84 which, as seen in FIG. 9, has the same configuration as the upper end of the rear part.

The front surface of the plate 84 includes a projecting L-shape ridge indicated at 86 in FIG. 9 with the short vertical leg 87 thereof forming one side of a coin chute indicated generally at 88. The other side of the coin chute is formed by ridge 89 which extends downwardly to inclined ridge 90. The ridge 90 terminates in a short downturned ridge indicated at 91. Parallel to the top of the ridge 90 and to the left of the ridge 89 there is provided a shoulder indicated at 92 so that between the parallel shoulder and the ridge 90 the plate is slightly recessed away from the viewer as seen in FIG. 9. The distance between the ridge 90 and the shoulder 92 may be slightly larger than the diameter of a U.S. dime although smaller than the U.S. nickel or quarter.

The plate 84 is provided with coin sorting holes indicated at 94, 95 and 96 which are each of a different size and configuration. The hole 96 is provided on its rear edge with a bevel seen at 97 which ensures that the dime will fall through the hole 94. A larger coin such as a nickel or quarter will drop over the edge of the ridge 90 onto inclined ramp 98 and roll to the right as seen in FIG. 9 past classifying holes 95 and 96. The nickel will fall through the hole 95 into the center chamber while the quarter will not, the quarter moving to the final larger hole 96 to fall into the larger right hand chamber.

When the cover plate 23 is in position the coins are of course confined in the chute formed by the ridges and ramps of the upper portion 82 of the front part. The chute 88 is of course aligned with the opening 34 in the top of the rear part and the coins drop initially onto the ridge 90 with dimes passing through the opening 94 into the left hand chamber, nickels and quarters dropping to the ramp 98 with the nickels dropping through the opening 95 to the center chamber while quarters roll onto the opening 96 to drop into the larger right hand chamber.

When the coins drop into the respective chambers, the stack of coins formed comes to rest at the back of each stack on a pair of sloping ramps seen at 100 and 102 which are formed between the respective semi-cylindrical vertical wall and the bottom wall 40 of the back part. The lowermost coins on each stack are also supported at the front of the stack by the top of the respective friction wheels. Thus the lowermost coin in each stack has a three-point support and because the stacks vary in diameter from left to right the angle of the shaft supporting the friction wheels is as shown in FIG. 5. The lower end of each semi-cylindrical wall 58, 59 or 60 of the front part is provided with an exit clearance indicated at 103, 104 and 105, respectively, in FIG. 2. The exit clearance 105 for the quarter chamber includes a center tab indicated at 106. The configuration of the exit clearances is such that only one coin at a time may be moved horizontally through such clearance.

As indicated, the parts 21, 22 and 23 are injection molded plastic parts and may be snapped together. The cover plate 23 is provided with one lower finger 108 and two upper fingers 109 which snap into the holes seen at 110 and 111 in the upper portion of the front part seen in FIG. 9. The front part also includes two small vertical projections 113 and 114 which project downwardly from the rear edge 67 of the bottom wall 66 and snap into holes 115 in the bottom wall 40 of the rear part when the rear edge is in abutment with the shoulder 42 as seen in FIG. 11. The upper portion of the front part includes two projecting ears 117 and 118 which snap into respective recesses 119 and 120 in the upper portion of the rear part as seen in FIG. 3. When the parts are snapped together the shaft 70 will be captured and the respective finger wheels positioned in the proper notches below the front edges of the chambers for the three stacks of coins.

Figure 4:
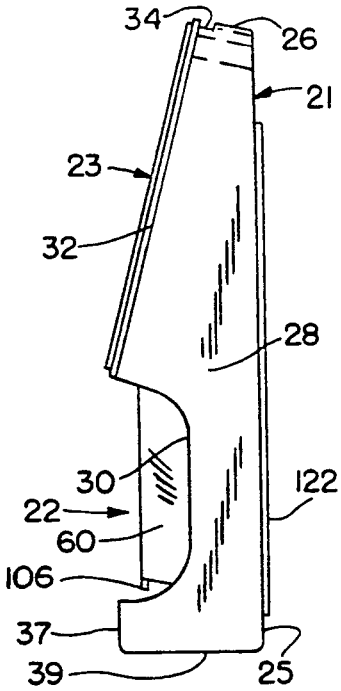
FIG. 4 is a side elevation as seen from the right hand side of FIG. 2.
Figure 2:
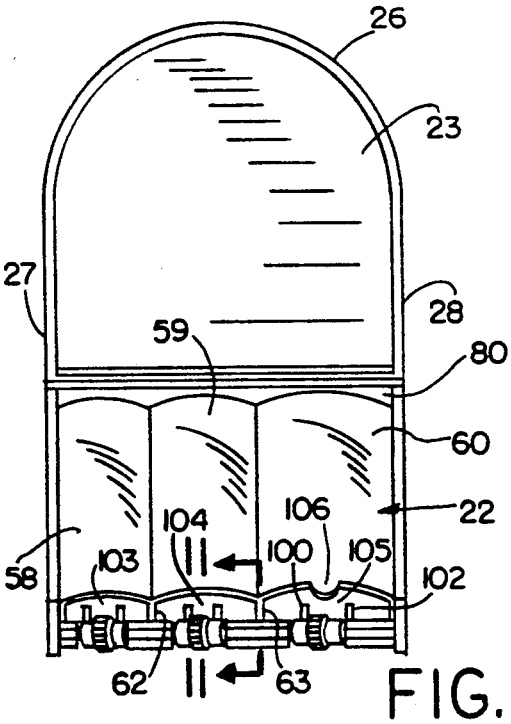
FIG. 2 is a front elevation of the coin sorter.

As seen in FIGS. 4 and 5 the rear 25 of the back part may be provided with magnetic tape indicated at 122 so that the coin sorter and dispenser may be supported on a vertical surface such as a refrigerator door or wall. It will be appreciated that a peel-off adhesive pad may equally well be provided for such purpose. It will also be appreciated that the coin sorter may be supported on a horizontal surface as long as the friction wheels can be accessed. For example the coin sorter may be held in one hand to have the wheels operated by the other or it may be supported somewhat elevated on feet such as may be provided by downward extensions of the side walls.

It can now be seen that there is provided a coin sorter and dispenser which is assembled from three injection molded plastic parts and when assembled captures the shaft 70 and positions each friction wheel below the front lower edge of a stack of coins. Coins may be fed through the opening 34 into the chute 88 and roll down the ridge 90 and to drop onto the ramp 90 and be sorted through the holes 94, 95 and 96. Since the front part is transparent plastic the size of the stack of coins in each chamber is readily apparent. Then, when a selected coin is desired, the user simply engages the bottom of a selected friction wheel with a finger moving the wheel in a clockwise direction as seen in FIG. 11 to move the lowermost coin in the stack to the right as seen in FIG. 11 to drop into the hand of the user. In this manner the desired number and type of coins may quickly be dispensed from the bank.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A coin sorter and dispenser comprising a plurality of generally vertically extending side-by-side coin chambers of progressively increasing size which support stacks of coins, means for sorting coins of equal diameter into a chamber of corresponding size, the lower end of each chamber including coin support means and a forwardly extending coin exit clearance above said coin support means for each chamber, said coin support means including respective friction wheels supported by a shaft, said friction wheels engaging the lowermost coin in each stack, whereby when a selected friction wheel is rotated a coin will be dispensed from the respective stack through the respective exit clearance.

2. A coin dispenser as set forth in claim 1, said sorting means including a feed chute for coins above said chambers, said feed chute including classifying means to classify coins into the respective chambers.

3. A coin dispenser as set forth in claim 2 wherein said classifying means includes an inclined, two-stage ramp with coin sizing holes positioned along said ramp to allow coins of corresponding size to fall into respective chambers.

4. A coin dispenser as set forth in claim 3 wherein said coin dispenser comprises a front part and a rear part forming said chambers, the upper portion of said front part including an inclined wall which includes said ramp and coin sizing holes.

5. A coin dispenser as set forth in claim 4 including a cover plate extending over said inclined wall.

6. A coin dispenser as set forth in claim 5 wherein said front and rear parts and cover are snap-together injection molded plastic parts.

7. A coin dispenser as set forth in claim 1 wherein each friction wheel is a soft plastic material.

8. A coin dispenser as set forth in claim 1 wherein each friction wheel is exposed at the bottom of each chamber of the dispenser whereby each wheel may be rotated by the finger of a user engaging the bottom of the wheel to rotate the top of the wheel toward the user to dispense the lowermost coin in a stack out of the chamber through the exit clearance into the hand of the user.

9. A coin dispenser as set forth in claim 1 wherein each wheel includes a serrated surface to facilitate rotation and frictional engagement with the lowermost coin of each stack.

10. A coin dispenser as set forth in claim 1 wherein the respective friction wheel is positioned to engage the lowermost coin of each stack near the front edge of each chamber and said coin support means includes means at the rear of each chamber to transfer the weight of the coin to the respective friction wheel.

11. A coin dispenser as set forth in claim 10 whrein said last mentioned means comprises at least one inclined ramp, so that each lowermost coin is supported by said ramp at the rear edge and by the top of the friction wheel at the front edge.

12. A coin sorter and dispenser comprising a plurality of generally vertically extending side-by-side coin chambers of progressively increasing size which support stacks of coins, means for sorting coins of equal diameter into a chamber of corresponding size, the lower end of each chamber including coin support means and a forwardly extending coin exit clearance above said coin support means for each chamber, said coin support means including respective friction wheels engaging the lowermost coin in each stack, whereby when a selected friction wheel is rotated a coin will be dispensed from the respective stack through the respective exit clearance, and a shaft supporting said friction wheels for rotation, said chambers being formed by front and rear parts, said shaft being held in place by assembly of said front and rear parts.

13. A coin dispenser as set forth in claim 12 wherein said front and rear parts include forwardly extending cooperating projections capturing said shaft and limiting axial movement of said wheels along said shaft.

14. A coin dispenser as set forth in claim 12 wherein said chambers are side-by-side and of progressively increasing size, and said shaft extends at an appropriate angle to position each friction wheel near the front of each chamber.

15. A coin dispenser as set forth in claim 12 including means on said rear part to support said dispenser in an upright position on a vertical surface.

16. A coin dispenser as set forth in claim 15 wherein said parts are plastic and said last mentioned means comprises a section of magnetic tape adapted to support said dispenser in a vertical position on a metal surface.

* * * * *